US008276733B2

(12) United States Patent
Watanabe

(10) Patent No.: US 8,276,733 B2
(45) Date of Patent: Oct. 2, 2012

(54) SHEET PROCESSING SYSTEM, SHEET PROCESSING APPARATUS, AND SHEET PROCESSING METHOD

(75) Inventor: Satoshi Watanabe, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 272 days.

(21) Appl. No.: 12/498,411

(22) Filed: Jul. 7, 2009

(65) Prior Publication Data

US 2010/0001452 A1 Jan. 7, 2010

(30) Foreign Application Priority Data

Jul. 7, 2008 (JP) ..... 2008-176600

(51) Int. Cl.
*G07F 7/04* (2006.01)

(52) U.S. Cl. ..... 194/206

(58) Field of Classification Search ..... 194/205, 194/206, 207, 217; 235/379; 209/534; 700/215, 700/226; 902/20, 37, 38, 39, 40
See application file for complete search history.

(56) References Cited

U.S. PATENT DOCUMENTS 5,790,697 A 8/1998 Munro et al.
7,187,795 B2 * 3/2007 Jones et al. ..... 382/135
7,252,185 B2 * 8/2007 Fujita et al. ..... 194/350
7,978,899 B2 * 7/2011 Jenrick et al. ..... 382/135
2002/0056605 A1 5/2002 Mazur et al.
2004/0245066 A1 * 12/2004 Ichikawa et al. ..... 194/206
2008/0106726 A1 * 5/2008 Park ..... 356/71
2008/0197972 A1 * 8/2008 Lawson et al. ..... 340/5.86
2009/0222362 A1 * 9/2009 Stood et al. ..... 705/30

FOREIGN PATENT DOCUMENTS

CN 1607534 4/2005
JP 58-50085 3/1983
JP 2006-293464 10/2006

OTHER PUBLICATIONS

European Search Report dated Aug. 27, 2010.
Chinese Office Action dated Aug. 11, 2011.

* cited by examiner

*Primary Examiner* — Mark Beauchaine
(74) *Attorney, Agent, or Firm* — Pillsbury Winthrop Shaw Pittman, LLP

(57) ABSTRACT

A sheet processing system has a sheet processing apparatus and a server. The server stores, as sheet, the identification data of a sheet and the result of a process performed on the sheet in association. The server transmits the sheet data to the sheet processing apparatus. The sheet processing apparatus receives the sheet data from the server and stores the sheet data. The sheet processing apparatus acquires images of the sheet fed to it and acquires the identification data of the sheet on the basis of the images acquired. The sheet processing apparatus refers to the sheet data, discriminates the sheet on the basis of the identification data acquired, and classifies and collects the sheet in accordance with the result of discrimination.

12 Claims, 5 Drawing Sheets

| Identification data | A1234567890 | | | | |
|---|---|---|---|---|---|
| Process data | 2000-1-10 | 2003-1-10 | 2006-1-10 | 2008-1-10 | |
| Type | 1 | 1 | 1 | 1 | |
| Genuine/forged | Genuine | Genuine | Genuine | Forged | |
| Damaged/not damaged | | Not damaged | Damaged | Damaged | |
| Processing of damaged sheets | | | | | |
| Discarding of sheets discard | | | Discard | | |
| Location | Tokyo | Osaka | Nagoya | Ohita | |
| Apparatus number | A1 | A10 | A20 | A30 | |
| Remarks | Issuance | Ordinary process | Discarding | Processing of forged sheets | |
| | | | | | |

FIG. 5

SHEET PROCESSING SYSTEM, SHEET PROCESSING APPARATUS, AND SHEET PROCESSING METHOD

CROSS-REFERENCE TO RELATED APPLICATIONS

This application is based upon and claims the benefit of priority from prior Japanese Patent Application No. 2008-176600, filed Jul. 7, 2008, the entire contents of which are incorporated herein by reference.

BACKGROUND OF THE INVENTION

1. Field of the Invention

The present invention relates to a sheet processing system that process sheets.

2. Description of the Related Art

Sheet processing apparatuses have been put to practical use. Each sheet process apparatus counts and discriminate sheets of various types. In the apparatus, the sheets placed in the sheet hold unit are conveyed, one by one, to the inspection unit. The inspection unit detects light coming from each sheet and acquires an image based on the light. The sheet processing apparatus first examines the image thus acquired, and then determines whether the sheet is genuine, damaged or unusable. If the sheet is found to be unusable, the apparatus will rejects it. Further, the sheet processing apparatus classifies sheets into groups in accordance with whether they are genuine, damaged or unusable, and collects the sheets, group by group.

Identification data may be printed on each sheet in some cases. For example, Jpn. Pat. Appln. KOKAI Publication No. 2006-293464, a patent publication based on a Japanese patent application, describes a sheet processing apparatus. This apparatus reads the identification data printed on each sheet and changes the reference value used to inspect images in accordance with the identification data.

This sheet processing apparatus shreds any sheet that is damaged too much to be circulated again. Any sheet circulated for a long time since the issuance date is discriminated as a damaged one that should be cut into shreds, though it is not so much damaged. However, the sheet processing apparatus recognizes such a sheet as genuine if the sheet does not appear damaged. Therefore, the sheet cannot be processed as a damaged one as is desired.

If a forged sheet is found, it is demanded that any other sheet printed with the same identification data should be rejected. However, the sheet processing apparatus disclosed in the patent publication cannot confirm the identification data printed on the forged sheet. Consequently, the apparatus cannot reject such a sheet as demanded.

BRIEF SUMMARY OF THE INVENTION

According to one embodiment of the invention, an object of the invention is to provide a sheet processing system, a sheet processing apparatus and a sheet processing method, which can sort sheets into groups of various types.

A sheet processing system according to an embodiment of the invention has a sheet processing apparatus and a server. The server comprises: a sheet data storage unit configured to store, as sheet data, the identification data of each sheet and the result of processing the sheet in association; and a first transmission unit configured to transmit the sheet information stored in the sheet data storage unit, to the sheet processing apparatus. The sheet processing apparatus comprises: a storage unit configured to store the sheet information received from the server; a sheet hold unit configured to hold sheets; a sheet feed unit configured to feed sheets, one by one, from the sheet hold unit; a conveyor unit configured to convey sheets fed by the sheet feed unit; an image acquisition unit configured to acquire images of each sheets conveyed by the conveyor unit; an identification-data recognition unit configured to obtain the identification data from the images acquired by the image acquisition unit; a discrimination unit configured to refer to the sheet information stored in the storage unit, thereby to discriminate the sheet based on the identification data obtained by the identification-data recognition unit; and a collection unit configured to classify the sheets into groups on the basis of the result of discrimination performed by the discrimination unit, and to hold the groups of sheets thus formed.

A sheet processing apparatus according to an embodiment of the invention comprises: a storage unit configured to store sheet data received from an external apparatus; a sheet hold unit configured to hold sheets; a sheet feed unit configured to feed sheets, one by one, from the sheet hold unit; a conveyor unit configured to convey sheets fed by the sheet feed unit; an image acquisition unit configured to acquire images of each sheets conveyed by the conveyor unit; an identification-data recognition unit configured to obtain the identification data from the images acquired by the image acquisition unit; a discrimination unit configured to refer to the sheet information stored in the storage unit, thereby to discriminate the sheet based on the identification data obtained by the identification-data recognition unit; and a collection unit configured to classify the sheets into groups on the basis of the result of discrimination performed by the discrimination unit, and to hold the groups of sheets thus formed.

A sheet processing method according to an embodiment of the invention comprises: storing sheet data received from an external apparatus; feeding sheets, one by one, from a sheet holder; conveying sheets thus fed; acquiring images of each sheets conveyed; obtaining identification data from the images acquired; referring to the sheet information stored, thereby discriminating the sheet based on the identification data obtained; and classifying the sheets into groups on the basis of the result of discrimination performed, and holding the groups of sheets thus formed.

An embodiment of this invention can thus provide a sheet processing system, a sheet processing apparatus and a sheet processing method, which can classify sheets into groups of various types.

Additional objects and advantages of the embodiments will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

FIG. 5 is a table explaining an exemplary history information process; and

DETAILED DESCRIPTION OF THE INVENTION

A sheet processing system, a sheet processing apparatus and a sheet processing method, all according to an embodiments of this invention, will be described in detail with reference to the accompanying drawings.

Figure 1:
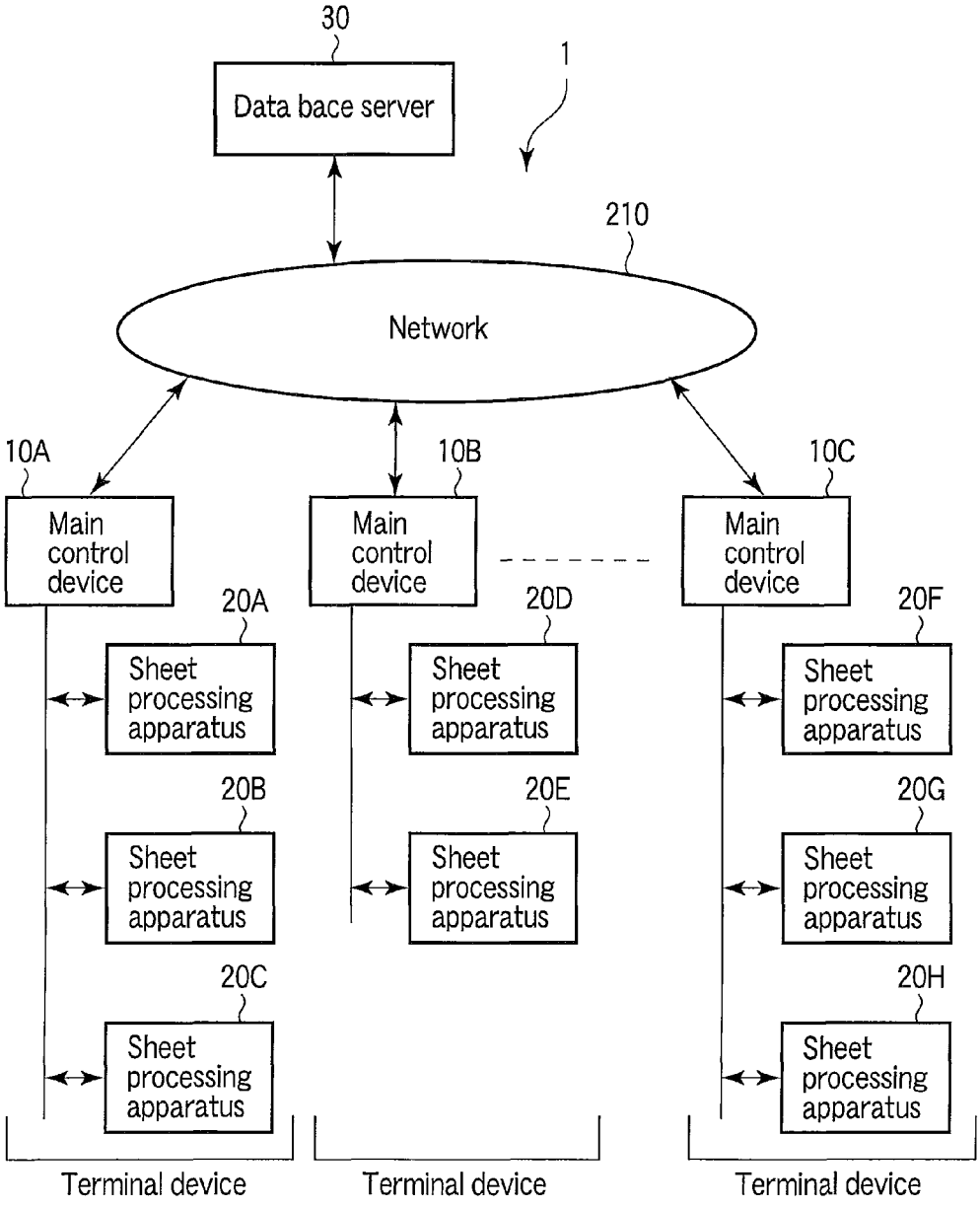
FIG. 1 is a diagram explaining an exemplary configuration of a sheet processing system according to an embodiment of the present invention.

FIG. 1 is a diagram showing an exemplary configuration of a sheet processing system according to the embodiment.

As shown in FIG. 1, the sheet processing system 1 comprises a main control device 10, a sheet processing apparatus 20, and a database server 30. The main control device 10 is connected to the sheet processing apparatus 20 by a network 210. Further, the main control device 10 and the sheet processing apparatus 20 are connected to each other by, for example, a LAN.

More precisely, the sheet processing system 1 of the embodiment has a plurality of main control devices, e.g., three main control devices 10A, 10B and 10C. Since main control devices 10A, 10B and 10C are identical in configuration, they will be described as a single main control device 10 in following description.

The database server 30 collects the result of sheet processing performed in the sheet processing device 20. The database server 30 generates and stores process history information that contains, as indices, the identification data items of sheets. The database server 30 distributes the process history information to the main control device 10 through the network 210.

The process of distributing the process history information is performed during a period while neither the sheet processing apparatus 20 nor the main control device 10 is operating, for example at night. This can prevent congesting on the network 210.

The main control device 10 receives the process history information from the database server 30. To the sheet processing apparatus 20, the sheet processing apparatus 20 is connected. More precisely, the sheet processing apparatuses 20A, 20B and 220C are connected to the main control devices 10A, 10B and 10C, respectively. Since the sheet processing apparatuses 20A, 20B and 220C are identical in configuration, they will be described as a single sheet processing apparatus 20.

The main control device 10 receives the process history information from the database server 30 and transmits the information to the sheet processing apparatus 20. The database server 30, the main control device 10, and the sheet processing apparatus 20 can therefore hold the same sheet process history information in common.

The sheet processing apparatus 20 takes in sheets, one by one, and performs image inspection and thickness detection on these sheets. From the images acquired from each sheet, the sheet processing apparatus 20 obtains identification data which printed on the sheet. The sheet processing apparatus 20 adds the identification data and the results of the processes performed on the sheet, generating process history information. The sheet processing apparatus sends the process history information, which represents the results of the processes, to the main control device 10. The main control device 10 receives the process history information from the sheet processing apparatus 20, and transmits the information to the database server 30.

The database server 30 compiles the process history information from the main control device 10. Then, the database server 30 updates the process information it stores, on the basis of the process information received from the main control device 10.

Figure 2:
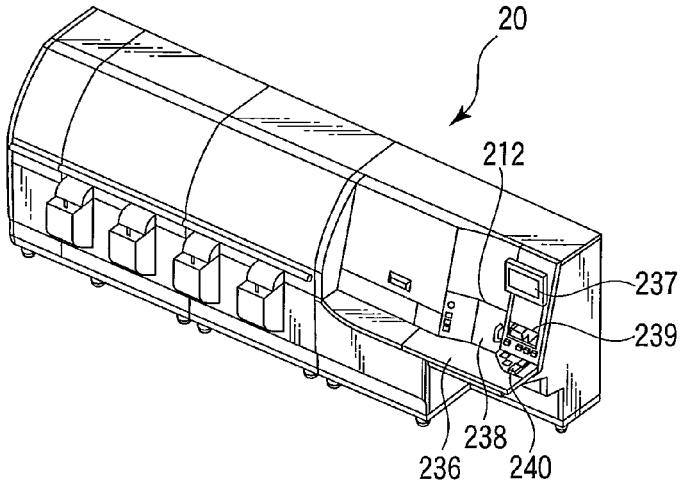
FIG. 2 is a diagram showing an exemplary outer appearance that the sheet processing apparatus of FIG. 1 may have.

FIG. 2 is a diagram showing an exemplary appearance that the sheet processing apparatus of FIG. 1 may have.

As shown in FIG. 2, the sheet processing apparatus 20 has a sheet hold unit 212, an operation unit 236, a process display unit 237, a door 238, a sheet outlet port 239, and a keyboard 240, all exposed outside.

The sheet hold unit 212 is to hold sheets together, which should be fed into the supply sheets, one by one. The operation unit 236 may be operated by the operator, to input various instructions. The process display unit 237 displays various guidance messages and the results of processes. Note that the process display unit 237 may be configured as a touch panel. In this case, the operator may touch buttons displayed on the process display unit 237 or may operate the process display unit 237, thus inputting instructions.

The door 238 may be manipulated to open or close the sheet inlet port made in the sheet hold unit 212. The sheet outlet port 239 is provided. Through the sheet outlet port 239, any sheet discriminated as a reusable one can be taken out of the sheet processing apparatus 20. The operator may operate the keyboard 240 to input various instructions.

Figure 3:
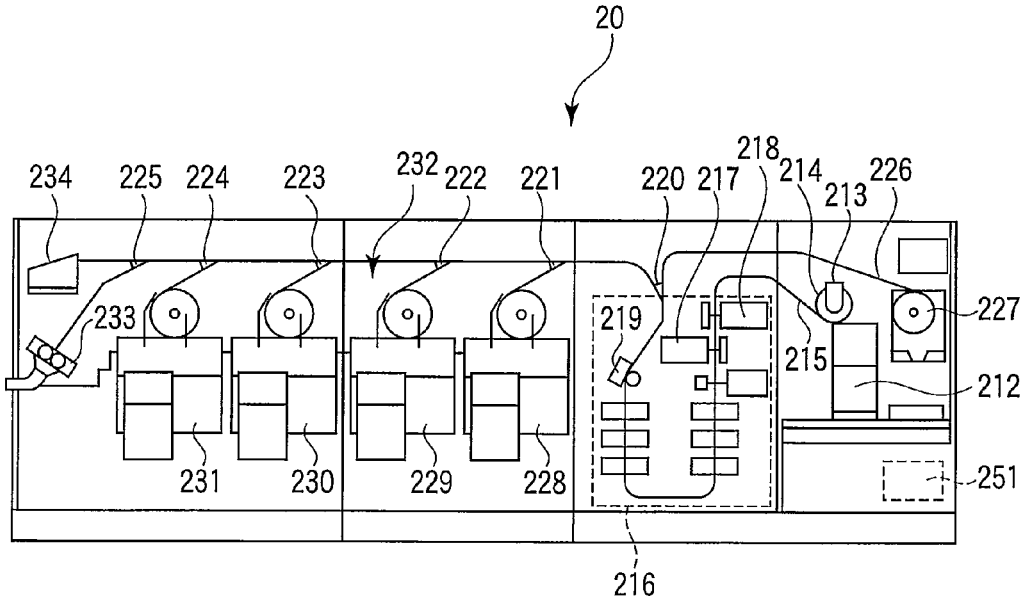
FIG. 3 is a diagram showing an exemplary configuration of the sheet processing apparatus shown in FIG. 1.

FIG. 3 is a diagram showing an exemplary configuration of the sheet processing apparatus 20 shown in FIG. 1.

The sheet processing apparatus 20 incorporates a sheet feed unit 213, a suction roller 214, a conveying path 215, an inspection unit 216, gates 220 to 225, a rejected sheet path 226, a rejected sheet reception unit 227, sheet collect/bundle unit 228 to 231, a shredder unit 233, and a stacker 234. The sheet processing apparatus 20 has a control unit 251. The control unit 251 controls some of the other components of the sheet processing apparatus 20.

The sheet feed unit 213 is arranged at the top of the sheet hold unit 212. The sheet hold unit 212 has the suction roller 214. The suction roller 214 is positioned, contacting the topmost of the sheets set in the sheet hold unit 212. The suction roller 214 can therefore feed the sheets, one by one, from the sheet hold unit 212 into the sheet-processing section of the sheet processing apparatus 20. The suction roller 214 feeds one sheet from the sheet hold unit 212, for example every time it rotates through 360°. Thus, the suction roller 214 feeds sheets at a predetermined pitch. In the sheet-processing section of the sheet processing apparatus 20, any sheet fed by the suction roller 214 is guided into the conveying path 215.

The conveying path 215 is a conveying means for transporting sheets to various units provided in the sheet processing apparatus 20. The conveying path 215 is composed of a conveyor belt (not shown) and drive pulleys (not shown). The conveying path 215 has an electric motor (not shown), too. The motor drives the conveyor belt. The conveyor belt conveys any sheet fed by the suction roller 214 at a constant speed. Hereinafter, the part of the conveyor belt, which is close to the sheet feed unit 213, will be described as upstream part, and that part of the conveyor belt, which is close to the stacker 234, will be described as downstream part.

The inspection unit 216 is arranged on the conveying path 215 that extends from the sheet feed unit 213. The inspection unit 216 comprises image read units 217 and 218 and a thickness detection unit 219. The inspection unit 216 detects the optical characteristic and magnetic characteristic of any sheet being conveyed through the conveying path 215. The sheet processing apparatus 20 can therefore determines the type, condition, position and genuineness of the sheet.

The image read units 217 and 218 are arranged, opposing each other across the conveying path 215. The image read units 217 and 218 read the images printed on any sheet being conveyed through the conveying path 215. The image read units 217 and 218 have a CCD camera each. In the sheet processing apparatus 20, the pattern images on the obverse and reverse sides of the sheet, respectively, are acquired from the images read by the image read units 217 and 218. From the images thus acquired, the control unit 251 determines whether the sheet is a genuine one, a damaged one or a rejected one.

A genuine sheet can be circulated again. In the sheet processing apparatus 20, genuine sheets are conveyed to the collect/bundle unit 228 to 231.

A damaged sheet is genuine but cannot be circulated again. In the sheet processing apparatus 20, damaged sheets are conveyed to the shredder unit 233. The shredder unit 233 cuts each damaged sheet into shreds. Note that in the sheet processing apparatus 20, damaged sheets may be conveyed to the stacker 234. In this case, the stacker 234 forms a bundle of sheets every time the number of bundles it has received reaches, for example, one hundred (100).

A rejected sheet is neither genuine nor damaged. In the sheet processing apparatus 20, rejected sheets are conveyed to the rejected sheet reception unit 227. Rejected sheets include inappropriately conveyed sheets such as two sheets taken in together, unacceptable sheets such as folded sheets and torn sheets, and unrecognizable sheets such as forged sheet.

The image read units 217 and 218 reads the images printed on the sides of the sheet, thereby generating image data. The image data is temporarily stored in a memory (not shown). The image data is supplied to the process display unit 237, which displays the image of the sheet.

The thickness detection unit 219 detects the thickness of the sheet coming through the conveying path 215. If the thickness detected is equal to or greater than a predetermined value, the sheet processing apparatus 20 determines that two sheets have been taken in together.

The inspection unit 216 has a magnetic sensor. The magnetic sensor detects the magnetic characteristic of each sheet.

On the conveying path 215 that is provided downstream in the inspection unit 216, the gates 220 to 225 are arranged, one after another. The gates 220 to 225 are controlled by the control unit 251. The control unit 251 controls the gates 220 to 225 in accordance with the result of the inspection the inspection unit 216 has performed. Thus, the control unit 251 ultimately controls the transport of the sheets in the conveying path 215, supplying the sheets to respective process units.

The gate 220, which is arranged immediately after the inspection unit 216, can guide sheets from the conveying path 215 into the rejected sheet path 226. More precisely, the gate 220 can be moved to guide any sheet determined as not genuine or any sheet determined as one the inspection unit 216 cannot inspect, into the rejected sheet path 226.

At the end of the rejected sheet path 226, the rejected sheet reception unit (or rejection unit) 227. The rejected sheet reception unit 227 collects such rejected sheets and such sheets unable to inspect, as described above. The sheets collected in the rejected sheet reception unit 227 can be removed outside through the sheet outlet port 239.

The conveying path 215 branches at four gates 221 to 224, forming four sub-paths. These sub-paths are connected to the sheet collect/bundle unit 228 to 231 (generally called "collect/bundle section 232"), respectively. The collect/bundle section 232 collects sheets found reusable and classifies them into groups, in accordance with their types and positions (obverse-side up or down). When the number of sheets forming each group reaches a prescribed value, the collect/bundle section 232 ties the sheets, forming a bundle. The sheet processing apparatus 20 has a bundle unit (not shown), which ties a prescribed number of bundles together, forming a larger bundle of sheets.

The conveying path 215 branches at the gate 225, too, forming a sub-path. This sub-path is connected to the shredder unit 233. The shredder unit 233 shreds any sheet coming from the gate 225, which is a genuine but so damaged too much to be used again.

That part of the conveying path 215, which extends forward from the gate 225, is connected to the stacker 234. While the sheet processing apparatus 20 remains in the damaged-sheet shredding mode, the control unit 251 controls the gate 225, causing the gate 225 to guide sheets to the shredder unit 233. While the sheet processing apparatus 20 remains in any other operating mode, the control unit 251 controls the gate 225, causing the gate 225 to guide sheets to the stacker 234.

The control unit 251 stores data representing the number of sheets collected in the collect/bundle section 232, data representing the number of sheets shredded by the shredder unit 233, and the identification data of any sheet shredded.

Figure 4:
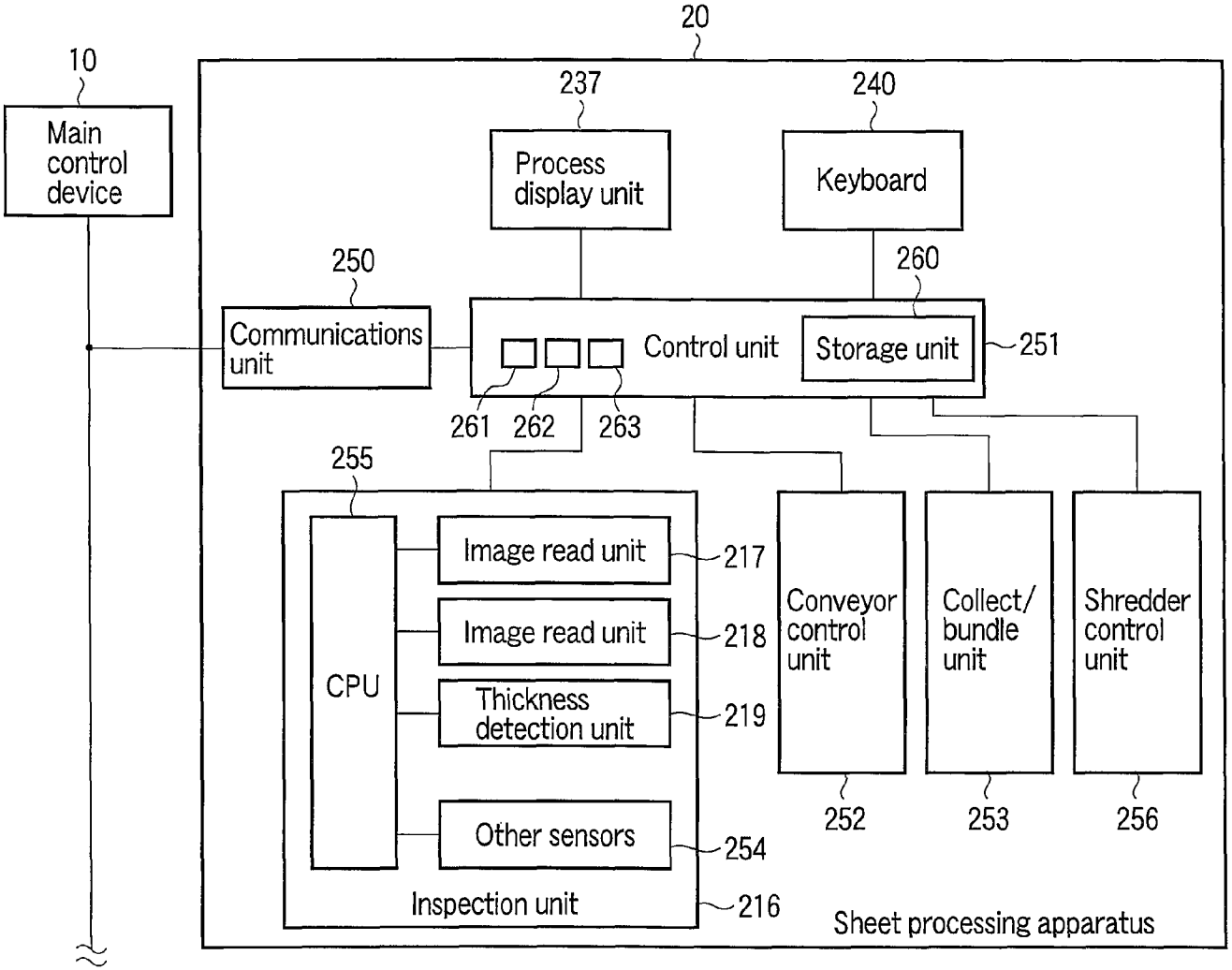
FIG. 4 is a block diagram showing an exemplary configuration the control system of the sheet processing apparatus shown in FIG. 1 may have.

FIG. 4 is a block diagram showing an exemplary configuration of the control system provided in the sheet processing apparatus 20 of FIGS. 1 and 2.

The sheet processing apparatus 20 comprises the control unit 251, inspection unit 216, communications unit 250, conveyor control unit 252, collect/bundle unit 253, shredder control unit 256, process display unit 237 and keyboard 240.

The control unit 251 controls some of the other components of the sheet processing apparatus 20. More precisely, the control unit 251 controls the conveyor control unit 252 and collect/bundle unit 253, in accordance with the instructions input at the process display unit 237 and the result of the inspection performed by the inspection unit 216.

The operator operates the process display unit 237 or the keyboard 240, inputting the types and numbers of sheets to process, a criterion level of inspecting sheets, the name of sheet source, and the process to perform on the sheets.

The inspection unit 216 comprises the image read units 217 and 218, thickness detection unit 219, other sensors 254 and CPU 255.

The image read units 217 and 218 read the images printed on the sides of each sheet being fed through the conveying path 215. The image read units 217 and 218 have a light-receiving element and an optical system each. The light-receiving element is, for example, a charge coupled device (CCD). The image read units 217 and 218 apply light to a sheet being fed. The optical system of either image read unit receives the light reflected from, or passing through, the sheet. In either light image read unit, the optical system applies the light to the CCD, which generates an electric signal (image signal).

The control unit 251 has stored reference-image data in a storage unit 260. The reference-image data represents various reference images. The control unit 251 compares images acquired from each sheet with the reference images stored in the storage unit 260, to determine whether the sheet is genuine, damaged or forged.

The thickness detection unit 219 detects the thickness of any sheet being conveyed through the conveying path 215. The other sensors 254 include, for example, a magnetic sensor. The magnetic sensor detects the magnetic characteristic of any sheet being conveyed through the conveying path 215.

The CPU 255 receives the data representing the results of inspection, from the image read units 217 and 218, thickness detection unit 219 and other sensor 254. From this data the CPU 255 determines the type, condition, position and genuineness of each sheet being conveyed through the conveying path 215.

When controlled by the control unit 251, the conveyor control unit 252 controls the sheet hold unit 212, conveying path 215, rejected sheet path 226 and gates 220 to 225. Thus, the conveyor control unit 252 controls the feeding and conveying of sheets. The conveyor control unit 252 also classifies sheets into groups, every type. In other words, the conveyor control unit 252 functions as sheet classification unit.

Controlled by the control unit 251, the collect/bundle unit 253 controls the rejected sheet reception unit 227 and the sheet collect/bundle unit 228 to 231. Thus, the rejected sheet reception unit 227 receives the rejected sheets, and the sheet collect/bundle units 228 to 231 collect and tie the sheets, forming bundles.

Controlled by the control unit 251, the shredder control unit 256 controls the shredder unit 233. The shredder unit 233 therefore shreds the sheets that have been conveyed to it.

The communications unit 250 is an interface that achieves communication between the main control device 10 and the sheet processing apparatus 20. In the sheet processing apparatus 20, the communications unit 250 receives process history information from the main control device 10. The control unit 251 of the sheet processing apparatus 20 includes the storage unit 260. The storage unit 260 stores the process history information received from the main control device 10.

The control unit 251 comprises a forged-sheet discrimination unit 261, a damaged-sheet discrimination unit 262, and a collation unit 263.

The forged-sheet discrimination unit 261 determines whether a sheet is a forged one or not. The damaged-sheet discrimination unit 262 determines whether a sheet is a damaged one or not. The collation unit 263 collates the result of processing any sheet with the process history information stored in the storage unit 260, determining whether the process history information shows the sheet has been shredded or not.

FIG. 5 is a diagram explaining an example of the process history information.

As seen from FIG. 5, the process history information may contain various data items such as "identification data," "process date," "sheet type," "location" and "process result." The process history information is stored in association with some other information, with the identification data used as an index. Further, the process history information contains the data indicating whether the sheet should be processed as a damaged one.

The "identification data" is data that is printed on the obverse side of a sheet when the sheet is issued. The identification data is unique to the sheet, never printed on any other sheet. The control unit 251 of the sheet processing apparatus 20 recognizes the identification data printed on the sheet on the basis of the images the image read units 217 and 218 have read from the sheet. Thus, the control unit 251 and the image read units 217 and 218 cooperate, functioning as an identification-data read unit.

The "process date" is data that represents the year, month and day when the sheet processing apparatus 20 processed the sheet having the associated identification data. The "sheet type" is data that represents the type of the sheet. The control unit 251 of the sheet processing apparatus 20 determines the type of a sheet by first acquiring the images of the sheet and then comparing the images with the reference images stored in the storage unit 260.

The "location" is data that represents either the location where the sheet processing apparatus 20 that has processed the sheet identified with the associated identification data or is the identification data identifying the sheet processing apparatus 20.

The "process result" is data that represents the result of the process performed on the sheet identified with the associated identification data, such as the result of determining whether the sheet is genuine or forged or whether the sheet is usable or damaged.

The process history information contains data that shows whether the sheet has been discarded or not. As described above, the sheet processing apparatus 20 shreds a sheet if the sheet is determined to be damaged. In this case, the control unit 251 adds, to the identification data of the sheet, the data showing that the sheet has been shredded.

If the identification data may contain, for example, the data showing that the sheet has been shredded, the control unit 251 can determine that sheet identified with the identification data is no longer circulated. The collation unit 263 of the control unit 251 extracts the identification data from the process history information and determines, from the identification data, whether the sheet is circulated or not. If the collation unit 263 finds that the sheet is no longer circulated, the control unit 251 regards the sheet as having been rejected. Any sheet that seems forged in all probability can therefore be selected.

The process history information contains data showing whether the sheet has been determined to be genuine or forged. As indicated above, the sheet processing apparatus 20 is collected in the rejected sheet reception unit 227 if it is found forged. In this case, the control unit 251 adds the data showing that the sheet is a forged one, to the identification data identifying this sheet.

Assume that the identification data of a sheet contains data showing that the sheet is a forged one. Then, the control unit 251 can recognize the sheet as having been processed as a forged sheet. The forged-sheet discrimination unit 261 of the control unit 251 extracts the identification data read from the sheet and determined, from the identification data, whether the sheet has been processed as a forged one. If the sheet is found to have been processed as such, the control unit 251 will perform a control to reject the sheet. Thus, any sheet that seems forged in all probability can therefore be selected.

Also assume that the identification data read from a sheet is not extracted from the process history information, or that the identification data does not exist in the identification data read from the sheet. In this case, the forged-sheet discrimination unit 261 discriminates the sheet as a forged sheet that has no process history.

The operator may input data at the keyboard 240 or the process display unit 237, thereby to designate the identification data of a sheet that should be processed as a damaged one. In this case, the control unit 251 of the sheet processing apparatus 20 adds process history information on the basis of the identification data thus input. Then, the control unit 251 retrieves the identification data from the storage unit 260 and adds, to the identification data, the data showing that the sheet should be processed as a damaged one.

After the identification data has been read from any sheet, the control unit 251 retrieves the identification data from the process history information stored in the storage unit 260. The control unit 251 then determines whether the identification data retrieved contains data showing that the sheet should be processed as a damaged one. If the identification data contains such data, the control unit 251 performs a control to process the sheet as a damaged sheet.

The operator may operate the keyboard 240 or the process display unit 237 to designate any sheet issued X years or more before as a damaged sheet. The sheet processing apparatus 20 can process any sheet so designated as a damaged sheet. The sheet can be designated by using either the process date or the identification data.

To designate the sheet by using the process date, the control unit 251 extracts the identification data about all sheets issued before the process date input. To designate the sheet by using the identification data, the control unit 251 extracts the identification data input, from the storage unit 260. Note that the identification data may be designated for the sheets issued for a specific period, such as "from year X to year Y."

In the control unit 251, the result of processing the sheet is stored in the storage unit 260 and added to the process history information stored in the storage unit 260. The communications unit 250 of the control unit 251 transmits the process history information now containing the result of processing the sheet, to the main control device 10.

The main control device 10 receives the process history information from the sheet processing apparatus 20. On receiving the information, the main control device 10 transmits the information to the database server 30.

The database server 30 compiles the process information items transmitted from the main control devices 10A, 10B and 10C. The database server 30 recognizes the process history information as index of the identification data items of sheets and updates the process history information it holds to the latest process history information.

The database server 30 distributes the process history information, thus updated, to the main control devices 10A, 10B and 10C connected by the network 210 to the database server 30. Each main control device 10 receives the process history information and transmits the information to the sheet processing apparatus 20 connected to the main control device 10. Thus, the process history information held in the main control device 10, the process history information held in the sheet processing apparatus 20, and the process history information held in the database server 30 are synchronous to one another.

As has been described, the sheet processing apparatus 20 discriminates any sheet issued long before or found too dirty or damaged, as a damaged sheet, as will be exemplified blow:

| | |
|---|---|
| Identification data: | A1234567890 |
| Sheet type: | 1 |
| Genuine/formed: | Forged |
| Damaged/not damaged: | Not damaged |
| Processed as damaged: | So processed |
| Shredded/reused: | Reused |
| Location: | Tokyo |

If the sheet processing apparatus 20 reads the above-mentioned identification data from the sheet, it processes the sheet as a damaged sheet. More precisely, the sheet processing apparatus 20 first refers to the information about "damaged-sheet process" and then recognizes the sheet as one to be processed as a damaged sheet.

The sheet processing apparatus 20 recognizes sheets not so dirty or damaged and issued a prescribed number of years before. Of the sheets issued many years before, they may differ in terms of security elements. In this case, sheets long used should better be processed as damaged ones. In the present embodiment, the sheet processing apparatus 20 can detect and select such sheets.

As described above, the sheet processing apparatus 20 recognizes, as a forged sheet, any sheet that was found in the past to be a forged one or different too much from the genuine one, as will be exemplified below:

| | |
|---|---|
| Identification data: | B1234567890 |
| Sheet type: | 1 |
| Genuine/formed: | Forged |
| Damaged/not damaged: | Not damaged |
| Processed as damaged: | So processed |
| Shredded/reused: | Reused |
| Location: | Tokyo |

If the sheet processing apparatus 20 reads the above-mentioned identification data from the sheet, it processes the sheet as a forged sheet. More precisely, the sheet processing apparatus 20 first refers to the information about "genuine/forged discrimination" and then recognizes the sheet as one that has been processed as a "forged sheet."

That is, the detection history of forged sheets is input to the sheet processing apparatus 20. Referring to this detection history, the sheet processing apparatus 20 can select the sheet having the same identification data as a sheet that was found to be a forged one.

As indicated above, the sheet processing apparatus 20 determines that the sheet is a forged one if it reads, from the sheet, the same identification data as that of a sheet that has been shredded. An example of a sheet the apparatus 20 so determines is as follows:

| | |
|---|---|
| Identification data: | A1234567890 |
| Sheet type: | 1 |
| Genuine/formed: | Genuine |
| Damaged/not damaged: | Not damaged |
| Processed as damaged: | So processed |
| Shredded/reused: | Shredded |
| Location: | Tokyo |

If the sheet processing apparatus 20 reads the above-mentioned identification data from the sheet, it processes the sheet as a forged sheet. That is, the sheet processing apparatus 20 first refers to the information about "shredded/reused discrimination" and then recognizes the sheet as one that has been "shredded."

Thus, the identification data of any sheet that has been shredded is input to the sheet processing apparatus 20. Referring to the identification data, the sheet processing apparatus 20 can select the sheet having the same identification data as a sheet that has been shredded.

FIG. 5 shows that a sheet having the identification data of "A1234567890" was issued on Jan. 10, 2000 by Apparatus A1 installed in "Tokyo." The identification data and other data items (shown in FIG. 5) about the sheet the Apparatus Al issued have been transmitted to, and registered in, the database server 30.

FIG. 5 shows that a sheet having the identification data of "A1234567890" was processed on Jan. 10, 2003 in Apparatus A10 installed in "Osaka." This sheet having the identification data of "A1234567890" has been discriminated as genuine and not damaged. That is, the sheet having the identification data of "A1234567890" is re-circulated at present.

FIG. 5 shows that a sheet having the identification data of "A1234567890" was processed on Jan. 10, 2006 by Apparatus A20 installed in "Nagoya." The sheet having the identification data of "A1234567890" has been is genuine and damaged. Therefore, this sheet has been shredded.

FIG. 5 also shows that a sheet having the identification data of "A1234567890" was processed on Jan. 10, 2008 by Apparatus A30 installed in "Ohita." Apparatus A30 determined that the sheet having the identification data of "A1234567890" was a forged sheet. In other words, Apparatus A30 detected that a sheet having this identification data of "A1234567890" had been shredded before.

Figure 6:
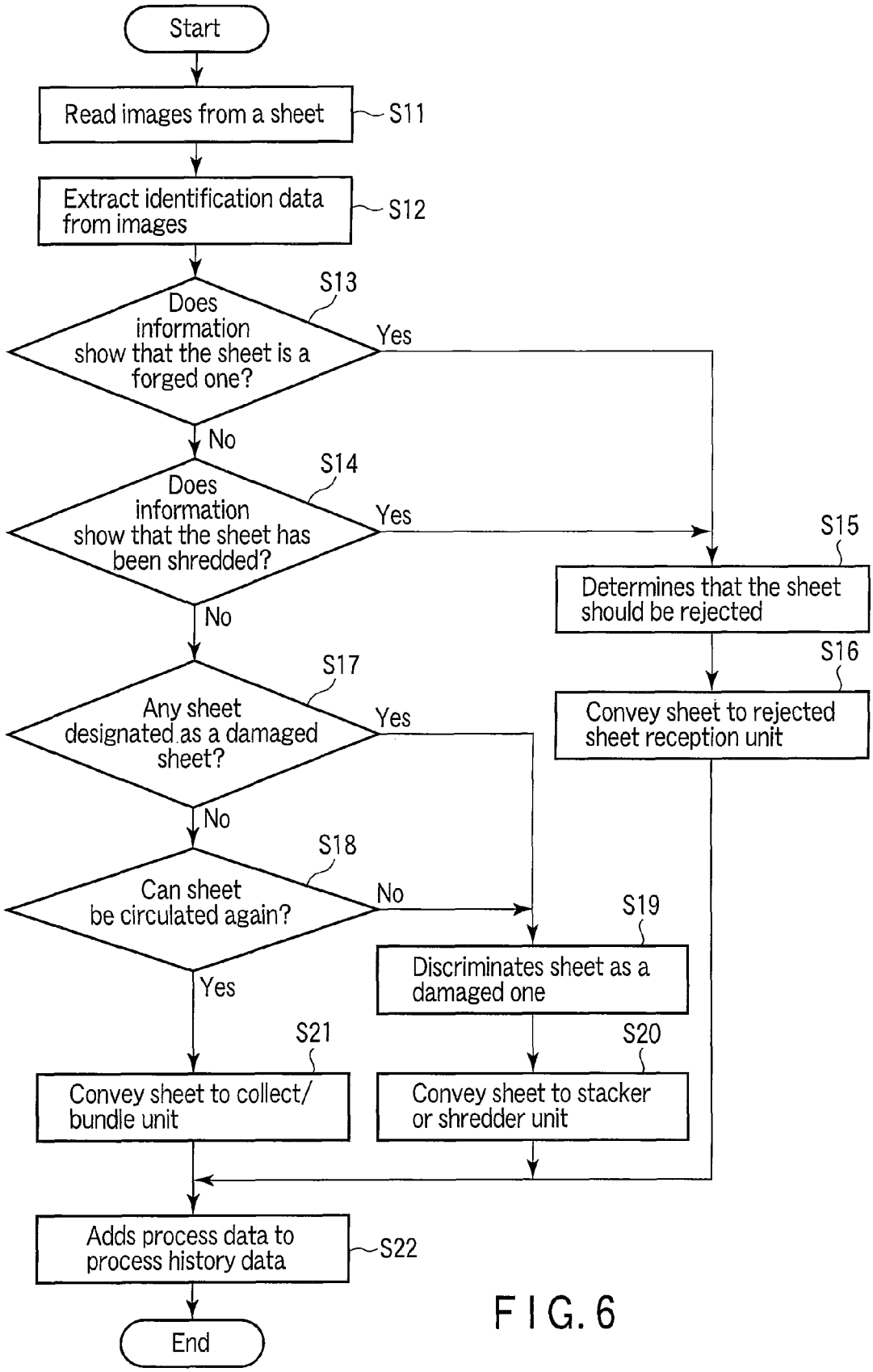
FIG. 6 is a flowchart explaining how the sheet processing apparatus of FIG. 1 operates.

FIG. 6 is a flowchart that explains how the sheet processing apparatus 20 operates.

The following explanation is based on the assumption that the process history information has been updated in the database server 30 and that the latest process history information is stored via the main control device 10 into the sheet processing apparatus 20.

Sheets are fed, one by one, at the sheet hold unit 212 of the sheet processing apparatus 20. In the apparatus 20, the image read units 217 and 218 acquire images from each sheet thus fed (Step S11). The CPU 255 extracts the identification data from the images the image read units 217 and 218 acquire images have acquired (Step S12). The identification data extracted is transmitted to the control unit 251.

The control unit 251 refers to the identification data and the process history information stored in the storage unit 260, thereby discriminating the sheet.

First, the control unit 251 determines whether the process history information includes a data item showing that the sheet has been determined to be a forged sheet (Step S13). Then, the control unit 251 determines whether the information includes a data item showing that the sheet has been shredded (Step S14).

If the process history information includes a data item showing that the sheet has been determined to be a forged sheet (if YES in Step S13), or a data item showing that the sheet has been shredded (If YES in Step S14), the control unit 251 determines that the sheet should be rejected (Step S15). That is, the control unit 251 discriminate the sheet as a sheet that is probably a forged one.

The control unit 251 controls the conveyor control unit 252, causing the same to convey the sheet discriminated as one to be rejected, to the rejected sheet reception unit 227 (Step S16).

The control unit 251 determines whether the sheet having the identification data received has been designated as a damaged sheet (Step S17). In other words, the control unit 251 determines whether the identification data received contains data representing the necessity of processing the sheet as a damaged one.

Further, the control unit 251 determines whether the sheet is damaged or not, from the images acquired by the image read units 217 and 218 (Step S18). More precisely, the control unit 251 compares the reference image stored in the storage unit 260 with the images acquired by the image read units 217 and 218, determining whether the sheet can be circulated again on the basis of the difference between the images compared.

If the sheet having the identification data received is found to be damaged (if YES in Step S17) or unable to circulate again (if NO in Step S18), the control unit 251 discriminates the sheet as a damaged one (Step S19). That is, the control unit 215 discriminates the sheet as not fit for recirculation.

Moreover, the control unit 251 controls the conveyor control unit 252, causing the same to convey any sheet discriminated as a damaged one, to the stacker 234 or the shredder unit 233 (Step S20).

In Step S18, the sheet may be found to be one that can be circulated again (that is, YES in Step 18). In this case, the control unit 251 discriminates the sheet as not damaged (Step S21).

The control unit 251 stores, in the storage unit 260, the data representing the process performed on the sheet (Step S22). In other words, the control unit 251 adds this data to the identification information about the sheet so processed.

As described above, when a sheet is issued in the sheet processing system 1 according to this embodiment, the identification data of the sheet is stored. When the sheet is processed, the result of the process is stored in association with the identification data. The sheet processing apparatus 20 can therefore reject any sheet having identification data showing that the sheet has been discriminated as a forged one. Further, the sheet processing apparatus 20 can process any sheet that has been issued a prescribed time before, as a damaged sheet, regardless of the result of comparing the reference image with the images acquired by the image read units 217 and 218. Still further, the sheet processing apparatus 20 can process a sheet having the same identification data as that of a sheet discarded as a damaged one, as a sheet that may be a forged one in all probability.

Hence, the present invention can provide a sheet processing system, a sheet processing apparatus, and a sheet processing method, which can classify sheets into groups of various types.

In the embodiment described above, the identification data added to each sheet is composed of number and symbol. The invention is not limited to the embodiment, nevertheless. The identification data may be a number only or a symbol only. Alternatively, the identification data may be a barcode or a two-dimensional code.

In the embodiment described above, the sheet processing apparatus 20 is configured to determine whether each sheet it has received should have been shredded before. The invention is not limited to this. The sheet processing apparatus 20 may transmit the identification data of the sheet and the data representing the result of process to the main control device 10, which may determine, from these data items, whether the sheet should have been discarded.

The embodiment described above is a sheet processing apparatus of ordinary type. Nonetheless, this invention can be applied to various types of apparatuses, e.g., automatic teller machines, automatic venders and bill-processing machines, each configured to acquire images from sheets, reads the identification data printed on each sheet and having a storage unit for storing the process history information about each sheet.

Further, the sheet processing apparatus 20 may possess a judgment unit more. The control unit 251 discriminates each sheet in terms of type, on the basis of the images acquired by the image read units 217 and 218. The control unit 251 refers to the process history information and to the type data associated with the identification data about the card, which has been read. For example, the control unit 251 performs a control to reject a sheet if the type of the sheet, which has been discriminated based on the images acquired, differs from the type data to which the control unit 251 has referred.

The sheet processing apparatus 20 according to the above-described embodiment is configured to retrieve the identification data of a sheet from the process history information, thus acquiring the history information about the sheet. The configuration of the sheet processing apparatus 20 is not limited to this. Instead, the apparatus 20 may be configured to read the identification data about any sheet to select and process from, for example, a RAM from which data can be read at high speed. In this case, the sheet processing apparatus 20 processes a sheet as a damaged sheet or a sheet to reject if the RAM stores identification data that is identical to the data acquired from the images.

That is, in this case, the sheet processing apparatus 20 first reads the process history information and then stores, in the RAM, the identification data about any sheet discriminated as a forged one.

The sheet processing apparatus 20 retrieves the process history information on the basis of the data input at the process display unit 237. More specifically, the sheet processing apparatus 20 extracts the identification data of any sheet issued within the period input at the process display unit 237 and stores the identification data in the RAM. The period input at the process display unit 237 may be, for example, from Jan. 10, 2000 to Jan. 10, 2004. If this is the case, the sheet processing apparatus 20 first reads the identification data items of all sheets issued during this period (i.e., Jan. 10, 2000 to Jan. 10, 2004) from the process history information and then stores these data items in the RAM.

The sheet processing apparatus 20, which is configured as described above, can discriminate forged sheets and damages sheets at high speed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet processing system having a sheet processing apparatus and a server, the server comprising:

a sheet data storage unit configured to store, as sheet data, the identification data of each sheet and the result of processing the sheet in association; and a first transmission unit configured to transmit the sheet information stored in the sheet data storage unit, to the sheet processing apparatus, and the sheet processing apparatus comprising:

a storage unit configured to store the sheet information received from the server;

a sheet hold unit configured to hold sheets;

a sheet feed unit configured to feed sheets, one by one, from the sheet hold unit;

a conveyor unit configured to convey sheets fed by the sheet feed unit;

an image acquisition unit configured to acquire images of each sheets conveyed by the conveyor unit;

an identification-data recognition unit configured to obtain the identification data from the images acquired by the image acquisition unit;

a discrimination unit configured to refer to the sheet information stored in the storage unit, thereby to discriminate the sheet based on the identification data obtained by the identification-data recognition unit; and a collection unit configured to classify the sheets into groups on the basis of the result of discrimination performed by the discrimination unit, and to hold the groups of sheets thus formed;

wherein the discrimination unit discriminates a sheet as a rejected sheet when history information representing that the sheet has been discriminated as being a forged sheet is associated with the identification data obtained by the identification-data recognition unit, in the sheet data that is stored in the sheet data storage unit; and wherein the storage unit is configured to extract sheet information according to input from the sheet data storage unit of the server and to store the extracted sheet information.

2. The sheet processing system according to claim 1, wherein the sheet processing apparatus further comprising a second transmission unit configured to transmit the result of the process performed by the discrimination unit, and the server further comprising an update unit configured to update the sheet data stored in the sheet data storage unit on the basis of the result of process received from the sheet processing apparatus.

3. The sheet processing system according to claim 1, wherein the discrimination unit discriminates a sheet as a rejected sheet when history information representing that the sheet has been discriminated as a discarded sheet is associated with the identification data obtained by the identification-data recognition unit, in the sheet data that is stored in the sheet data storage unit.

4. The sheet processing system according to claim 1, further comprising an input unit configured to input information, wherein the discrimination unit discriminates a sheet as a damaged sheet when the identification data obtained by the identification-data recognition unit is contained in the sheet data designated by the information input from the input unit.

5. The sheet processing system according to claim 1, wherein the discrimination unit recognizes the type of the sheet on the basis of the images acquired by the image acquisition unit and discriminates the sheet as being a rejected sheet when type data associated with the identification data recognized by the identification-data recognition unit represents a sheet type different from the sheet type recognized.

6. A sheet processing apparatus comprising:

a storage unit configured to store sheet data received from an external apparatus;

a sheet hold unit configured to hold sheets;

a sheet feed unit configured to feed sheets, one by one, from the sheet hold unit;

a conveyor unit configured to convey sheets fed by the sheet feed unit;

an image acquisition unit configured to acquire images of each sheets conveyed by the conveyor unit;

an identification-data recognition unit configured to obtain the identification data from the images acquired by the image acquisition unit;

a discrimination unit configured to refer to the sheet information stored in the storage unit, thereby to discriminate the sheet based on the identification data obtained by the identification-data recognition unit; and a collection unit configured to classify the sheets into groups on the basis of the result of discrimination performed by the discrimination unit, and to hold the groups of sheets thus formed;

wherein the discrimination unit discriminates a sheet as a rejected sheet when history information representing that the sheet has been discriminated as being a forged sheet is associated with the identification data obtained by the identification-data recognition unit, in the sheet data that is stored in the sheet data storage unit; and wherein the storage unit is configured to extract sheet information according to input from the sheet data storage unit of the server and to store the extracted sheet information.

7. The sheet processing apparatus according to 6, wherein the discrimination unit discriminates a sheet as a rejected sheet when history information representing that the sheet has been discriminated as a discarded sheet is associated with the identification data obtained by the identification-data recognition unit, in the sheet data that is stored in the sheet data storage unit.

8. The sheet processing apparatus according to 6, further comprising an input unit configured to input information, wherein the discrimination unit discriminates a sheet as a damaged sheet when the identification data obtained by the identification-data recognition unit is contained in the sheet data designated by the information input from the input unit.

9. The sheet processing apparatus according to 6, wherein the discrimination unit recognizes the type of the sheet on the basis of the images acquired by the image acquisition unit and discriminates the sheet a rejected sheet when type data associated with the identification data recognized by the identification-data recognition unit represents a sheet type different from the sheet type recognized.

10. A sheet processing method comprising:

storing sheet data received from an external apparatus;

feeding sheets, one by one, from a sheet holder;

conveying sheets thus fed;

acquiring images of each sheets conveyed;

obtaining identification data from the images acquired;

referring to the sheet information stored, thereby discriminating the sheet based on the identification data obtained; and classifying the sheets into groups on the basis of the result of discrimination performed, and holding the groups of sheets thus formed;

wherein a sheet is discriminated as a rejected sheet when history information representing that the sheet has been discriminated as being a forged sheet is associated with the identification data obtained, in the sheet data that has been stored; and wherein the storage unit is configured to extract sheet information according to input from the sheet data storage unit of the server and to store the extracted sheet information.

11. The sheet processing method according to claim 10, wherein a sheet is discriminated as a rejected sheet when history information representing that the sheet has been discriminated as a discarded sheet is associated with the identification data obtained, in the sheet data that has been stored.

12. The sheet processing method according to claim 10, wherein a sheet is discriminated as a damaged sheet when the identification data obtained by the identification-data recognition unit is contained in the sheet data designated by the information that has been input.

* * * * *